US010156820B2

(12) United States Patent
Ishii

(10) Patent No.: US 10,156,820 B2
(45) Date of Patent: Dec. 18, 2018

(54) TEMPERATURE CONTROL FOR SHEET HEATING DEVICE

(71) Applicants: KABUSHIKI KAISHA TOSHIBA, Tokyo (JP); TOSHIBA TEC KABUSHIKI KAISHA, Tokyo (JP)

(72) Inventor: Hiroshi Ishii, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 107 days.

(21) Appl. No.: 15/423,489

(22) Filed: Feb. 2, 2017

(65) Prior Publication Data

US 2018/0217534 A1 Aug. 2, 2018

(51) Int. Cl.
*G03G 15/20* (2006.01)
*G03G 21/20* (2006.01)

(52) U.S. Cl.
CPC ..... *G03G 15/2039* (2013.01); *G03G 21/203* (2013.01)

(58) Field of Classification Search
CPC ..... G03G 15/205
See application file for complete search history.

(56) References Cited

U.S. PATENT DOCUMENTS 4,791,453 A * 12/1988 Koseki ..... G03G 15/2003 347/900
5,682,577 A * 10/1997 Kiyoi ..... G03G 15/2003 219/494
8,744,291 B2 * 6/2014 Kobayashi ..... G03G 15/80 399/33
8,938,178 B2 * 1/2015 Tanaka ..... G03G 15/205 399/67
9,069,304 B2 * 6/2015 Seshita ..... G03G 15/205
9,561,678 B2 * 2/2017 Yamaguchi ..... B41M 7/0009
9,996,044 B2 * 6/2018 Yada ..... G03G 15/2039

FOREIGN PATENT DOCUMENTS

JP H08-286552 A 11/1996

* cited by examiner

*Primary Examiner* — Clayton E Laballe
*Assistant Examiner* — Leon W Rhodes, Jr.
(74) *Attorney, Agent, or Firm* — Patterson & Sheridan, LLP

(57) ABSTRACT

A sheet heating device includes a heater, a power supply for the heater, and a control unit configured to set an initial power supply level of the power supply at a start of a sheet heating job by the heater based on the sheet heating job and according to whether or not maximum and minimum power supply levels from a last sheet heating job are stored, and control the power supply level of the power supply during the sheet heating job based on a temperature detected by the temperature sensor.

20 Claims, 9 Drawing Sheets

FIG.5

DEFAULT POWER SUPPLY LEVELS UNDER NORMAL AMBIENT TEMPERATURE

| | | **Medium M1 (standard)**<br><br>**Medium M2**<br>Upper limit : 9/10<br>Lower limit : 2/3<br><br>**Medium M3**<br>Upper limit : 4/5<br>Lower limit : 1/2 |
|---|---|---|
| Minimum | | 60% |
| Temperature range 4 (Section 4) | Upper limit | 65% |
| | Lower limit | 60% |
| Temperature range 3 (Section 3) | Upper limit | 70% |
| | Lower limit | 65% |
| Temperature range 2 (Section 2) | Upper limit | 95% |
| | Lower limit | 70% |
| Temperature range 1 (Section 1) | Upper limit | 100% |
| | Lower limit | 75% |
| Maximum | | 100% |

FIG.9

DEFAULT POWER SUPPLY LEVELS UNDER NORMAL AMBIENT TEMPERATURE

| | | Medium M1 (Standard) | Medium M2 | Medium M3 |
|---|---|---|---|---|
| Minimum | | 60% | 40% | 30% |
| Temperature range 4 (Section 4) | Upper limit | 65% | 59% | 52% |
| | Lower limit | 60% | 40% | 30% |
| Temperature range 3 (Section 3) | Upper limit | 70% | 63% | 56% |
| | Lower limit | 65% | 43% | 33% |
| Temperature range 2 (Section 2) | Upper limit | 95% | 86% | 76% |
| | Lower limit | 70% | 47% | 35% |
| Temperature range 1 (Section 1) | Upper limit | 100% | 90% | 80% |
| | Lower limit | 75% | 50% | 38% |
| Maximum | | 100% | 90% | 80% |

TEMPERATURE CONTROL FOR SHEET HEATING DEVICE

FIELD

This specification relates to a temperature control technology for sheet heating.

BACKGROUND

In the related art, a sheet heating device which supplies a large amount of electric power to a heater to quickly raise a temperature thereof to a predetermined temperature during start-up, image fixing, or image decoloring is known. In the above conventional sheet heating device, because a large amount of electric power is supplied, the variation in the resulting heater temperature of the heater tends to be large.

For example, when starting up the sheet heating device after the sheet heating device has been turned off or has gone into a sleep mode, a large amount of electric power is supplied to the heat source to quickly raise the heater temperature to bring the sheet heating device to a warmed-up state. The large amount of electric power supplied may, however, cause overshooting of the heater temperature, because the heater temperature at the time of the start-up may be higher than its normal powered-off temperature. This overshooting is undesirable because it results in unnecessary power consumption.

Overshooting may also occur when raising the heater temperature of the sheet heating device to perform image fixing or image decoloring. The overshooting that results during this process is undesirable because when sheets are subjected to temperatures that are much higher than a target fixing or decoloring temperature, melted toner may remain on the sheets after they have been processed to cause the sheets to adhere to each other after they are discharged. In some cases, the overshooting may even cause image fixation failure.

DESCRIPTION OF THE DRAWINGS

FIGS. 5 and 9 are tables showing upper and lower limits of levels of electric power supplied to a heater of the sheet heating device for different media.

DETAILED DESCRIPTION

According to an aspect of the present invention, there is provided a sheet heating device that includes a heater, a power supply for the heater, and a control unit configured to set an initial power supply level of the power supply at a start of a sheet heating job by the heater based on the sheet heating job and according to whether or not maximum and minimum power supply levels from a last sheet heating job are stored, and control the power supply level of the power supply during the sheet heating job based on a temperature detected by the temperature sensor.

According to another aspect of the present invention, there is provided a temperature control method for a sheet heating device having a heater, a temperature sensor configured to detect the temperature of the heater, and a power supply for the heater. The method includes detecting a temperature of the heater, setting an initial power supply level of the power supply at a start of a sheet heating job by the heater based on the sheet heating job and according to whether or not maximum and minimum power supply levels from a last sheet heating job are stored, and controlling the power supply level of the power supply during the sheet heating job based on a temperature detected by the temperature sensor.

According to still another aspect of the present invention, there is provided a sheet heating device that includes a heater, a power supply for the heater, and a control unit configured to set an initial power supply level of the power supply at a start of a sheet heating job by the heater based on the sheet heating job and according to maximum and minimum power supply levels from a last sheet heating job, determine upper and lower limit power supply levels of the power supply for each of a plurality of temperature ranges, and control a temperature of the heater during the sheet heating job by setting the power supply level of the power supply to one of the upper and lower limit power supply levels based on the current temperature of the heater.

Embodiment of the present invention is explained below with reference to the accompanying drawings.

Figure 1:
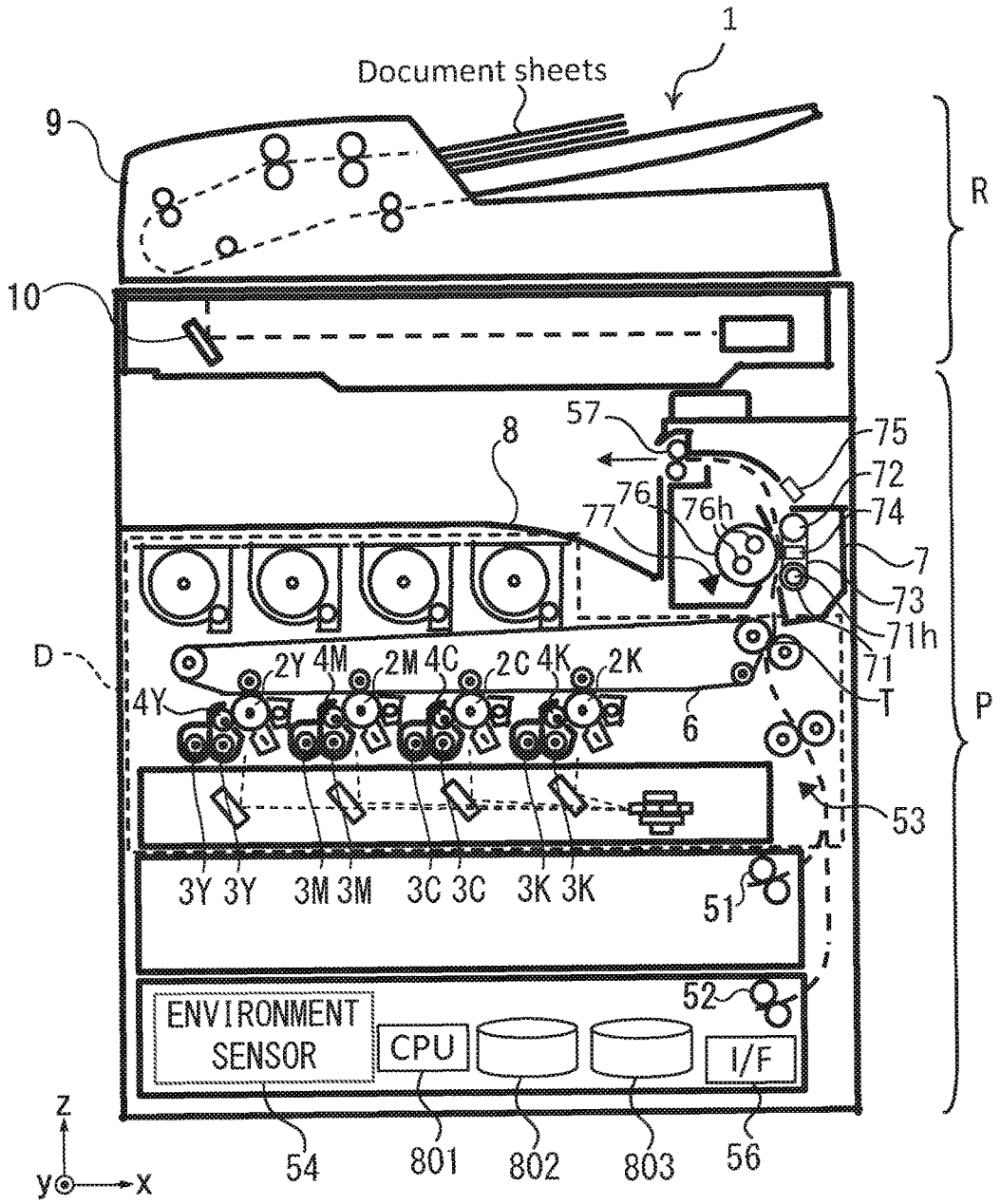
FIG. 1 is a vertical cross-sectional view of an image processing apparatus having a sheet heating device in which embodiments may be carried out.
Figure 2:
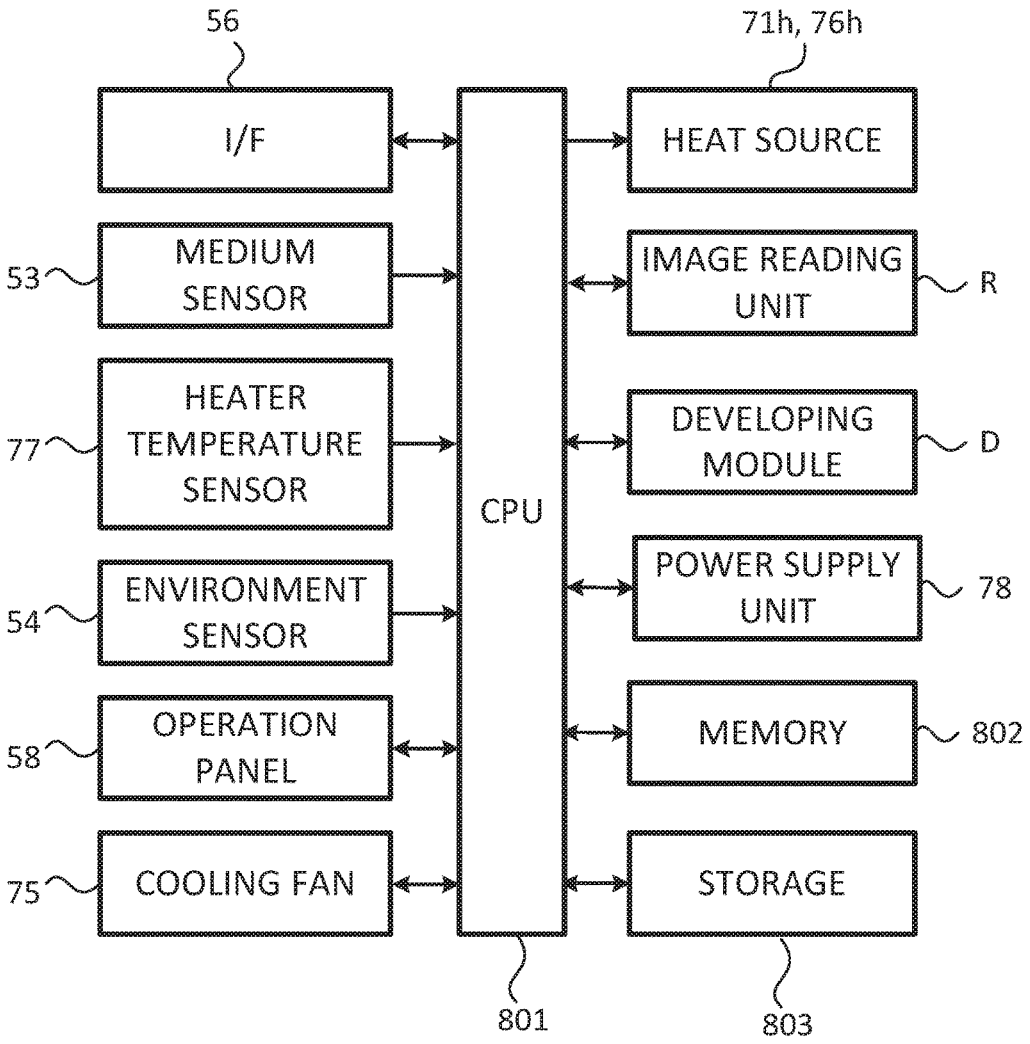
FIG. 2 is a block diagram illustrating components of the image forming apparatus under control of a central processing unit.

Referring now to the drawings, an image processing apparatus having a sheet heating device will be described. FIG. 1 is a vertical cross-sectional view of an image processing apparatus 1 (e.g., a multi-function peripheral or MFP for short), in which embodiments may be practiced. FIG. 2 is a block diagram of components of the image processing apparatus 1 under control of a central processing unit (CPU).

As shown in FIG. 1, the image processing apparatus 1 includes an image reading unit R and an image forming unit P. The image reading unit R includes hardware elements that are configured to scan an image from a sheet-type original or a book-type original and acquire image data that is used in forming an image on a sheet. The image forming unit P includes hardware elements that are configured to form an image on a sheet such as a printing paper or a film on the basis of the image data that the image reading unit R acquires from the original or image data transmitted from an external device.

A flow of an image forming operation carried out by the image forming apparatus will be described using a multi-color copying example.

First, the image reading unit R scans an image of an original placed at an image scanning position by an ADF 9 or placed manually thereat by the user, for image scanning to be performed by a scanning optical system 10 or a scanner (not shown) in the ADF 9.

Second, the image forming unit P forms electrostatic latent images on photoconductive surfaces of photoconductive drums (2Y, 2M, 2C, 2K) for yellow (Y), magenta (M), cyan (C), and black (K), on the basis of an operation input made through an operation panel (not shown) by the user and the image data acquired by the image reading unit R. Subsequently, toner which is stirred with carrier by mixers (3Y, 3M, 3C, 3K) in developing units (EY, EM, EC, EK) is supplied to the photoconductive surfaces of the photoconductive drums (2Y, 2M, 2C, 2K) from developing rollers (4Y, 4M, 4C, 4K) to form toner images on the photoconductive surfaces. The toner images formed on the photoconductor surfaces are transferred to a surface of a rotating intermediate transfer belt 6, and the rotating intermediate transfer belt 6 transports the toner images to a transfer position T where the toner images are transferred onto a sheet.

In parallel, the sheet is picked up from a cassette by one of pickup rollers 51 and 52 and transferred to the transfer position T by a plurality of roller pairs.

Within the image processing apparatus 1, a developing section D includes the photoconductive drums 2Y to 2K, the developing rollers 4Y to 4K, the mixers 3Y to 3K, the rotating intermediate transfer belt 6, and the plurality of roller pairs. Also, as illustrated herein, the developing unit EY includes the developing rollers 4Y and the mixers 3Y, the developing unit EM includes the developing rollers 4M and the mixers 3M, the developing unit EC includes the developing rollers 4C and the mixers 3C, and the developing unit EK includes the developing rollers 4K and the mixers 3K. When the sheet is transferred to the transfer position T from the cassette, a medium sensor 53 detects a physical characteristic of the sheet, e.g., a thickness of the sheet, a color of the surface of the sheet, or a reflectivity of the surface of the sheet. From the physical characteristic of the sheet, the sheet type may be determined by a control unit, which in the embodiments illustrated herein, is a programmed processor (e.g., CPU 801 shown in FIG. 1). In alternative embodiments, the control unit may be an application specific integrated circuit, a programmable logic device, or a field programmable gate array.

After the toner images are transferred to the sheet, the sheet is supplied to a nip formed between a heat roller 76 (which transfers heat to the sheet and is referred to herein more generally as a heater) and an endless belt 73 of a sheet heating device 7. The endless belt 73 is wound between an entrance side roller 71 and an exit side roller 72. The heat roller 76 has heat sources 76*h* provided therein. The entrance side roller 71 also has a heat source 71*h*. A nip pad 74 presses against an inner surface of the endless belt 74 toward the heat roller 76. A temperature of an outer surface of the heat roller 76 is detected by a temperature sensor 77. The CPU 801 controls a power supply unit 78 (in FIG. 2) to supply electric power to each of the heat sources 71*h* and 76*h*. The CPU 801 also acquires the maximum and minimum power supply levels of the power supply unit 78 during a heating job.

The sheet heating device 7 carries out a fixing process based on at least the type of sheet, and ambient temperature. The type of sheet is determined by the CPU 801 based on the physical characteristic (type information) of the sheet detected by the medium sensor 53 or alternatively inputs made by the user through the operation panel 58. The environment sensor 54 includes temperature and humidity sensors that respectively detect ambient temperature and ambient humidity. The sheet having an image fixed thereon is conveyed through a conveyance path by a plurality of conveying roller pairs and is discharged onto a discharge tray 8 by discharge rollers 57.

In further embodiments, the image forming apparatus carries out an image forming process using decolorable colorants, which are decolored when heated above a decoloring temperature thereof.

Further, the sheet heating device 7 can also carry out a decoloring process to decolor an image formed on a sheet with the decolorable colorants. When the sheet heating device 7 performs the decoloring process, a processing mode of the image processing apparatus 1 is switched from an image forming mode to a decoloring mode. While in the decoloring mode, the sheet heating device 7 heats a sheet at a decoloring temperature, which is higher than the temperature for fixing a decolorable image on the sheet. The image processing apparatus 1 discharges the sheet decolored by the sheet heating device 7 to the discharge tray 8. The sheet decolored by the sheet heating device 7 is cooled by a cooling fan 75 just after passing the nip between the heat roller 76 and the endless belt 73 to prevent the decolored sheet from sticking because of melted toner.

After the decoloring process has been carried out, the cooling fan 75 also cools down the heat roller 76, the entrance side roller 71, the exit roller 72 and the endless belt 73 to prepare for the next job.

In one embodiment, the heat roller 76 has an outer surface coated with PFA (p-fluorophenylalanine), and the nip pad 74 has a pressing portion formed with silicone rubber, which contacts the inner surface of the endless belt 73. The heat sources 76*h* are, for example, halogen lamps (600 W each), and the heat source 71*h* in the entrance side roller 71 is also halogen lamp (300 W×1).

When the sheet heating device 7 heats the sheet for image forming with the decolorable toner, the target temperature for the heat roller 76 is about 100° C., and the target temperature for the entrance side roller 71 is about 90° C.

When the sheet heating device 7 heats the sheet for the decoloring process, the target temperature for the heat roller 76 is about 120° C., and the target temperature for the entrance side roller 71 is about 110° C.

When the sheet heating device 7 heats the sheet for image forming with non-decolorable toner, the target temperature for the heat roller 76 is about 100-170° C., and the target temperature for the entrance side roller 71 is 70-90° C.

FIG. 2 is a block diagram illustrating components of the image forming apparatus under control of the CPU 801. These components include memory 802 and storage 803, which are connected to the CPU 801 through a BUS.

In one embodiment, the memory 802 is a semiconductor memory. The memory 802 includes a ROM (Read Only Memory) that stores a control program of the processor 801 and a RAM (Random Access Memory) that provides a temporary operation space for the processor 801.

The processor 801 controls the operation of the image forming unit P, the image reading unit R, a developing section D, the sheet heating device 7, a communication I/F 56, and other units of the image processing apparatus 1, which is described in this embodiment, by executing a control program or the like stored in the memory 802 or the storage 803. Further, the processor 801 is programmed to perform various image processing functions. In alternative embodiments, the processor 801 may be replaced by an ASIC (Application Specific Integrated Circuit) or programmable logic devices such as FPGA (Field Programmable Gate Array) that implements some or all of the functions of the processor 801.

The storage 803 stores application programs and the OS in a non-volatile manner. The application programs include a program that executes the functions of the image processing apparatus 1, including a copy function, a print function, and a scanner function. Further, the storage 803 stores image data generated when the image reading unit R reads a copy or data acquired from an external device connected to the communication I/F 56 through a network.

Examples of the storage 803 include a magnetic-storage device, such as a hard disk drive, an optical storage device, a semiconductor storage device (flash memory or the like), or a combination of these devices.

Figure 3:
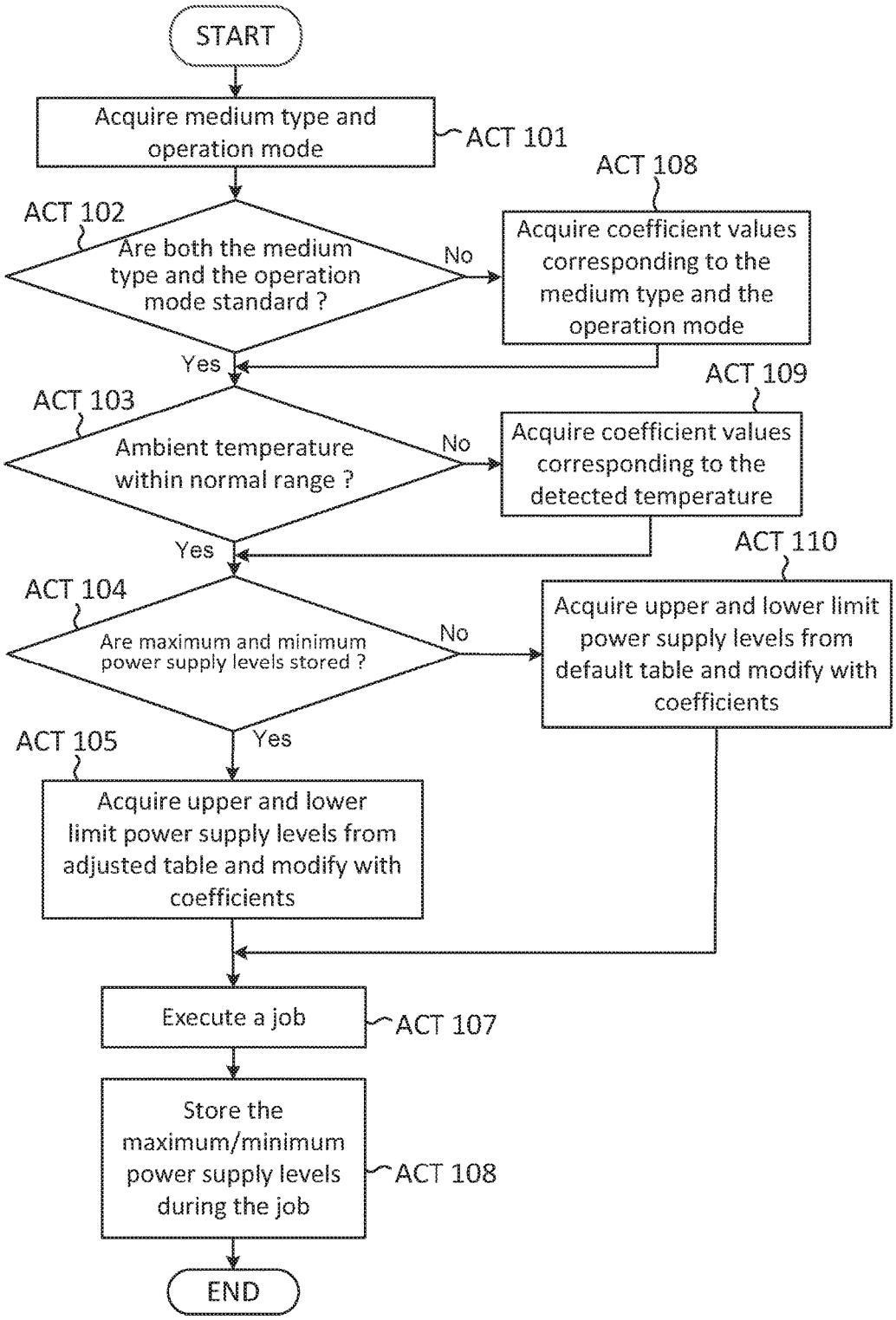
FIG. 3 depicts a flow chart of an operation to control electric power supplied to the heater.
Figure 4:
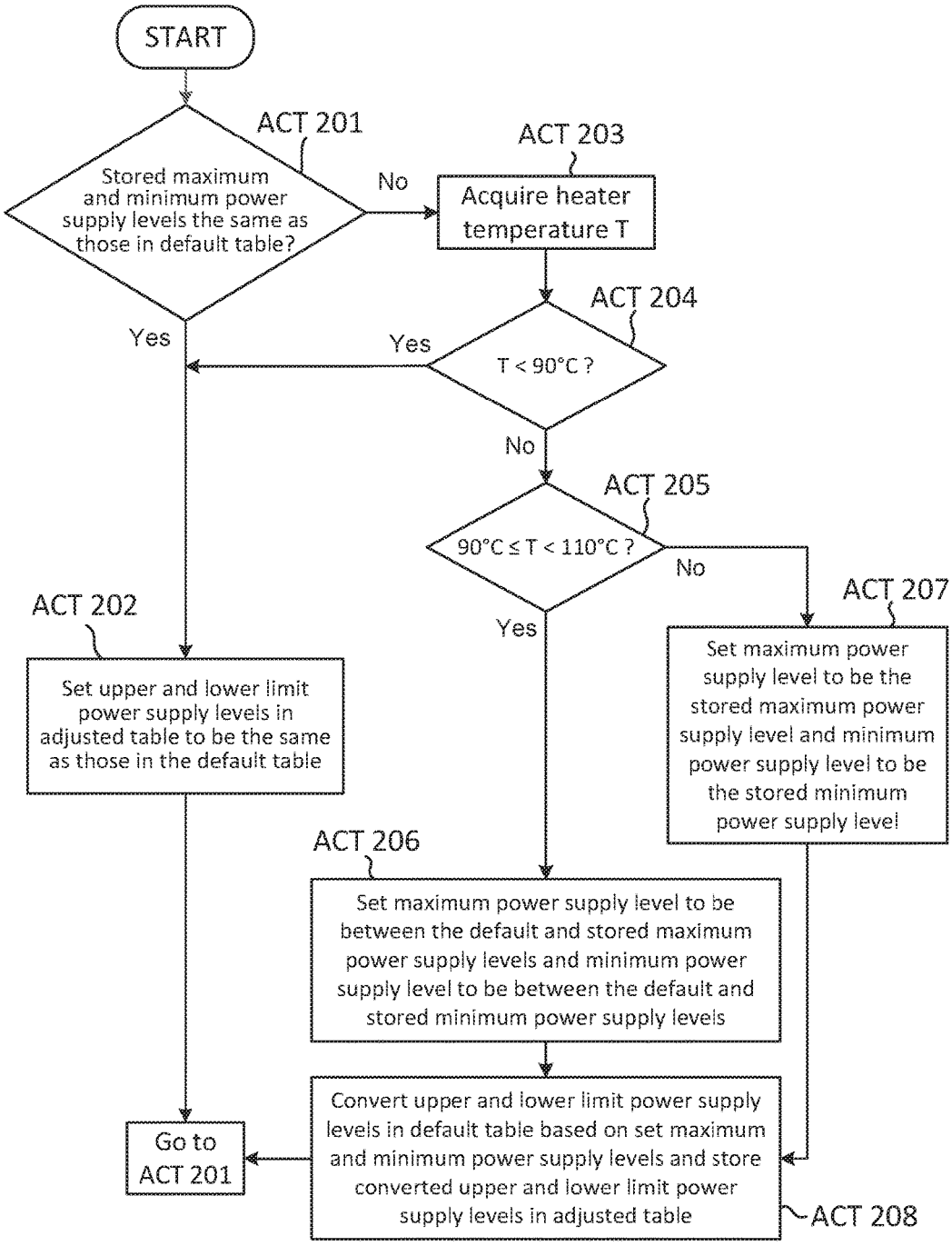
FIG. 4 depicts a flow chart of an operation to set upper and lower limits of levels of electric power supplied to a heater of the sheet heating device.

FIGS. 3 and 4 are flow charts of an operation to control power supplied to the heat sources 71*h* and 76*h* by the power supply unit 78. The power supplied to the heat sources 71*h* and 76*h* by the power supply unit 78 is controlled based on upper/lower limit power supply levels for different temperature ranges defined in a table such as the table shown in FIG. 5. The table shown in FIG. 5 will have different temperature ranges defined for different processes (e.g., non-decolorable image forming process, decolorable image forming process, decoloring process, etc.). The control process described below is applied to control the heat sources 71*h* and 76*h* together but it may be applied to control the heat sources 71*h* and 76*h* independently. The operation depicted in FIG. 4 is repeatedly executed to adjust the default upper and lower limit values stored in the table shown in FIG. 5 when maximum and minimum levels of power supplied by the power supply unit 78 are stored in the storage 803 from a previous heating job.

In the embodiments, CPU 801 controls the power supplied to the heat sources 71*h* and 76*h* by the power supply unit 78 during a heating job according to predetermined factors that cause fluctuations in reaching the target temperature of the sheet heating device. These predetermined factors include, without limitation:

1. the type of media (thickness, material, and the like)
2. ambient temperature
3. power supplied to the heat sources 71*h* and 76*h* during a previous heating job.

The operation depicted in FIG. 3 is carried out for a new heating job, which the user may initiate through the operational panel or which may be received through the communication interface 56. First, CPU 801 determines the type of sheet medium (also referred to herein as "medium type") which is subjected to the sheet heating process and an operating mode of the sheet heating device 7. The medium type is determined based on a detection result of the medium sensor 53 or an operation input made by the user, and the operating mode, which may be image forming mode or decoloring mode, is determined based on an operation input made by the user or a heating job received from an external device through the communication I/F 56 (ACT 101).

Next, the CPU 801 determines whether the medium type is a standard medium type and whether the operating mode is a standard operating mode (ACT 102). The standard medium type is, for example, a plain paper sheet having a paper weight (in grams per square meter) in the range of 61 g/m2 to 80 g/m2. The standard operating mode is, for example, an image forming process using a non-decolorable toner which is thermally non-decolorable.

If the medium type and the operating mode are not both standard (ACT 102, No), CPU 801 acquires predetermined coefficient values corresponding to the medium type and the operating mode from the storage 803 (ACT 108). If the medium type is M2, then, as shown in FIG. 5, coefficient values of 9/10 for upper limit values and 2/3 for lower limit values are acquired from the storage 803. If the medium type is M3, then, as shown in FIG. 5, coefficient values of 4/5 for upper limit values and 1/2 for lower limit values are acquired from the storage 803. Coefficient values can be defined for different types of operating modes as well. However, in the embodiments described herein, coefficient values for all non-standard operating modes are assumed to be one to simplify the description. After ACT 108, CPU 801 proceeds to execute ACT 103.

On the other hand, if the medium type and the operating mode are both standard (ACT 102, Yes), CPU 801 proceeds directly to ACT 103 to determine whether the ambient temperature is within the normal range, e.g., 17° C.~35° C. Here, CPU 801 may further determine whether the humidity is within the normal range, e.g., 45%~85% (as defined in JIS Z 8703). Here, the ambient temperature and the ambient humidity are detected by the environment sensor 54.

If the ambient temperature is not within the normal range (ACT 103, No), CPU 801 acquires predetermined coefficient values corresponding to the detected ambient temperature from the storage 803 (ACT 109). Coefficient values can be defined and acquired for the detected ambient humidity outside the normal range as well. After ACT 109, CPU 801 proceeds to execute ACT 104.

On the other hand, if the ambient temperature is within the normal range (ACT 103, Yes), CPU 801 proceeds directly to ACT 104 to determine whether maximum and minimum power supply levels are stored in the storage 803 (ACT 104). If no such information is stored, this indicates that no heating job was executed before the current one. The maximum and minimum power supply levels of the power supply unit 78 during the previous heating job is stored respectively as the maximum and minimum power supply level in the storage 803 at ACT 108 after the previous heating job was executed at ACT 107.

If the information corresponding to the maximum and minimum power supply levels of the power supply unit 78 is not stored in the storage 803 (ACT 104, No), CPU 801 acquires upper and lower limit power supply levels from the default table stored in the storage 803 (shown in FIG. 5) and modifies them according to any coefficient values acquired in ACT 108 and ACT 109 (ACT 110).

In FIG. 5, the upper and lower limits of power supply levels for medium type M1 (standard medium type) under normal ambient temperature and normal ambient humidity are defined for different ranges of detected heater temperatures. The upper and lower limits of the initial power supply level for medium types M2 and M3 are obtained by multiplying the coefficient values for medium types M2 and M3 to the upper and lower limits defined for medium type M1.

Figure 6:
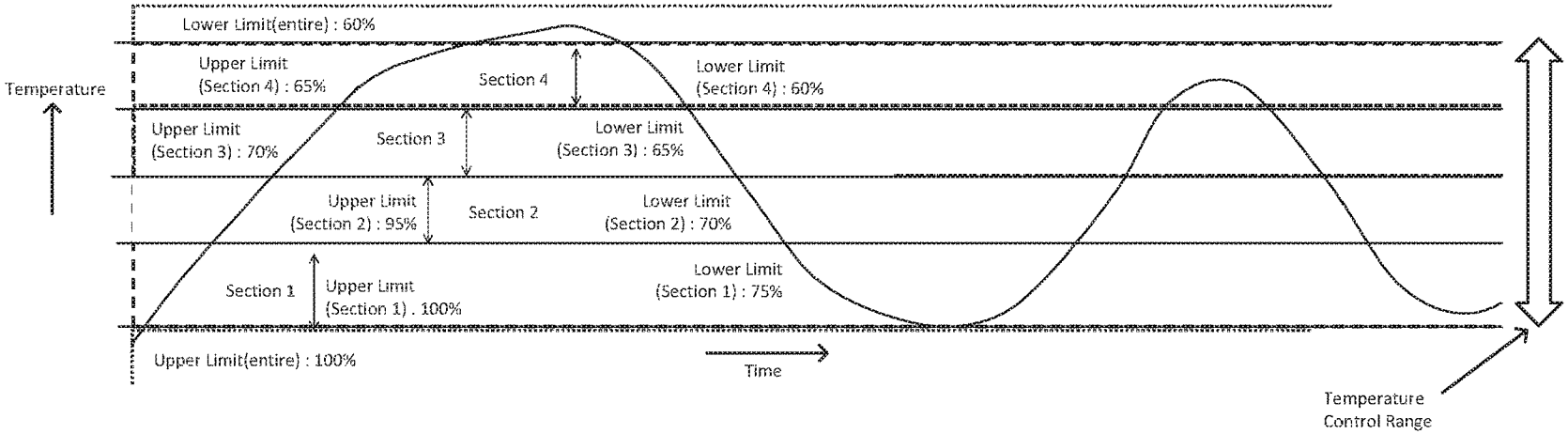
FIGS. 6, 7, and 8 are graphs showing temperature changes of the heater during feedback control of the heater to a target temperature.
Figure 7:
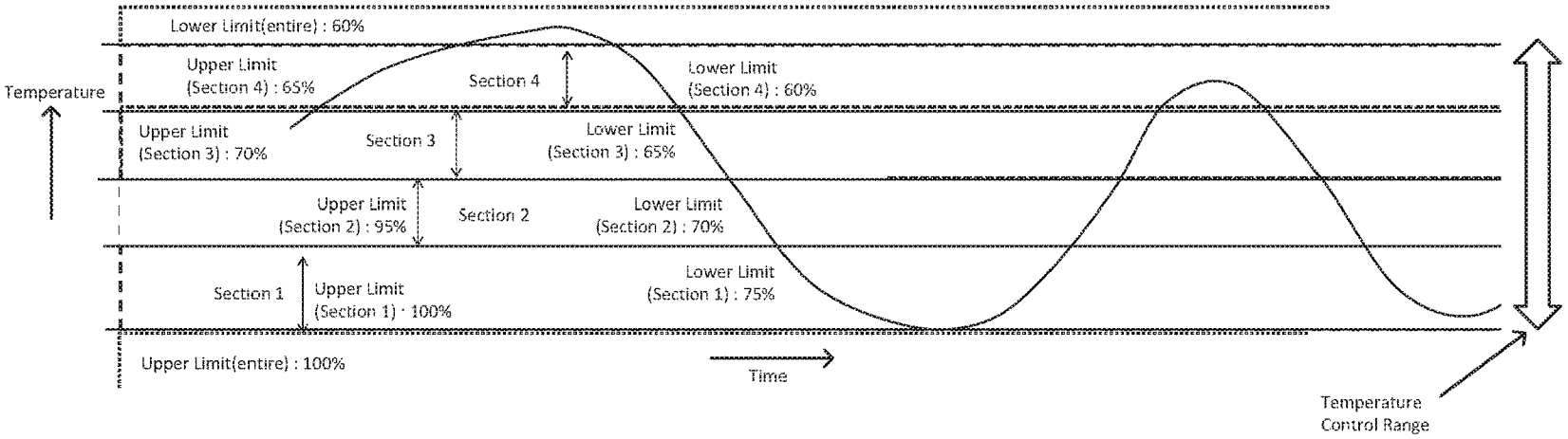

In FIG. 6, the temperature change of the heater during feedback control of the heater to a target temperature (under normal ambient temperature and normal humidity) is shown, where the initial heater temperature is below the Section 1 temperatures. In FIG. 7, the temperature change of the heater during feedback control of the heater to a target temperature (under normal ambient temperature and normal humidity) is shown, where the initial heater temperature is in the range of Section 3 temperatures.

Returning to ACT 104, if the information corresponding to the maximum and minimum power supply levels of the power supply unit 78 is stored in the storage 803 (ACT 104, Yes), CPU 801 acquires upper and lower limit power supply levels from an adjusted table stored in the storage 803 and modifies them according to any coefficient values acquired in ACT 108 and ACT 109 (ACT 105). The values of the adjusted table are set in accordance with the method depicted in FIG. 4, which is repeatedly executed to keep the values of the adjusted table updated based on the latest maximum and minimum power supply levels of the power supply unit 78 stored in the storage 803.

In the flow chart of FIG. 4, CPU 801 determines whether the maximum and minimum power supply levels of the power supply unit 78 stored in the storage 803 are the same as those in the default table (ACT 201). If the maximum and minimum power supply levels of the power supply unit 78 stored in the storage 803 are the same as those in the default table (ACT 201, Yes), CPU 801 executes ACT 202, where CPU 801 sets the upper and lower limit power supply levels in the adjusted table to be the same as those in the default table.

On the other hand, if the maximum and minimum power supply levels of the power supply unit 78 stored in the storage 803 are not equivalent to those in the default table (ACT 201, No), CPU 801 acquires the heater temperature T detected by the heater temperature sensor 77 (ACT 203).

CPU 801 determines whether the heater temperature T is lower than a predetermined lower limit threshold (e.g., 90° C.) (ACT 204) or is between the predetermined lower limit threshold and a predetermined upper limit threshold (e.g., 110° C.) (ACT 205).

If the heater temperature T lower than the predetermined lower limit threshold (ACT 204, Yes), CPU 801 executes ACT 202 described above. If the heater temperature T is equal to or higher than the predetermined lower limit threshold and is lower than the predetermined upper limit threshold (ACT 205, Yes), CPU 801 executes ACT 206, where CPU 801 sets the maximum power supply level to be between the default and stored maximum power supply levels and the minimum power supply level to be between the default and stored minimum power supply levels. In one embodiment, the maximum and minimum power supply levels (MAX, MIN) are set according to the following formulas:

$$MAX=\text{stored maximum}+|\text{default maximum}-\text{stored maximum}|\times 0.5$$

$$MIN=\text{stored minimum}+|\text{default minimum}-\text{stored minimum}|\times 0.4$$

If the heater temperature T is equal to or higher than the predetermined upper limit threshold (ACT 205, No), CPU 801 executes ACT 207, where CPU 801 sets the maximum power supply level to be the stored maximum power supply level and the minimum power supply level to be the stored minimum power supply level.

CPU 801 executes ACT 208 after both ACT 206 and ACT 207. In ACT 208, CPU 801 converts upper and lower limit power supply levels in the default table based on the maximum and minimum power supply levels set in ACT 206 or ACT 207 and stores the converted upper and lower limit power supply levels in the adjusted table. The conversion is carried out in the following manner. For each of the upper limit values, scale the default value up or down by the same percentage difference between the set maximum and the default maximum. Therefore, if the set maximum is 80% and the default maximum is 100%, reduce each of the upper limit values by 20%. In addition, for each of the lower limit values, scale the default value up or down by the same percentage difference between the set minimum and the default minimum. Therefore, if the set minimum is 30% and the default minimum is 60%, reduce each of the lower limit values by 50%.

In addition, CPU 801 erases the stored maximum and minimum power supply levels, if either of the following conditions is satisfied:

1. an elapsed time from a power-off of the apparatus is longer than a predetermined time; and
2. the heater temperature T when starting the current heating job is below a predetermined threshold temperature.

After acquiring the upper and lower limit power supply levels, CPU 801 starts the sheet heating job (ACT 107) using the upper or lower limit power supply level as the initial power supply level depending on whether the current detected temperature is above or below the target sheet heating temperature of the operation mode. If the current detected temperature is above the target sheet heating temperature, the lower limit power supply level is used. If the current detected temperature is below the target sheet heating temperature, the upper limit power supply level is used. In addition, if during the heating, the current detected temperature is above the target sheet heating temperature, CPU 801 causes the power supply unit 78 to supply electric power to the heat sources **71*h* and 76*h* at the lower limit corresponding to the current heater temperature. On the other hand, if during the heating, the current detected temperature is below the target sheet heating temperature, CPU 801 causes the power supply unit 78 to supply electric power to the heat sources 71*h* and 76*h* at the upper limit corresponding to the current heater temperature. By controlling the power supply unit 78 in this manner, the temperature detected by the heater temperature sensor 77** remains close to the target temperature of the operation mode.

After the completion of the heating job (ACT 107), CPU 801 acquires the maximum and minimum power supply levels of the power supply unit 78 during the just-completed heating job. In ACT 108, CPU 801 stores the maximum and minimum power supply levels of the power supply unit 78 in the storage 803. If the medium type during the just-completed heating job is not standard or the ambient temperature or the ambient humidity is not within the normal range, CPU 801 converts the maximum and minimum power supply levels so that they are normalized to the standard medium type (medium type M1) and to normal ambient temperatures and humidity.

Figure 8:
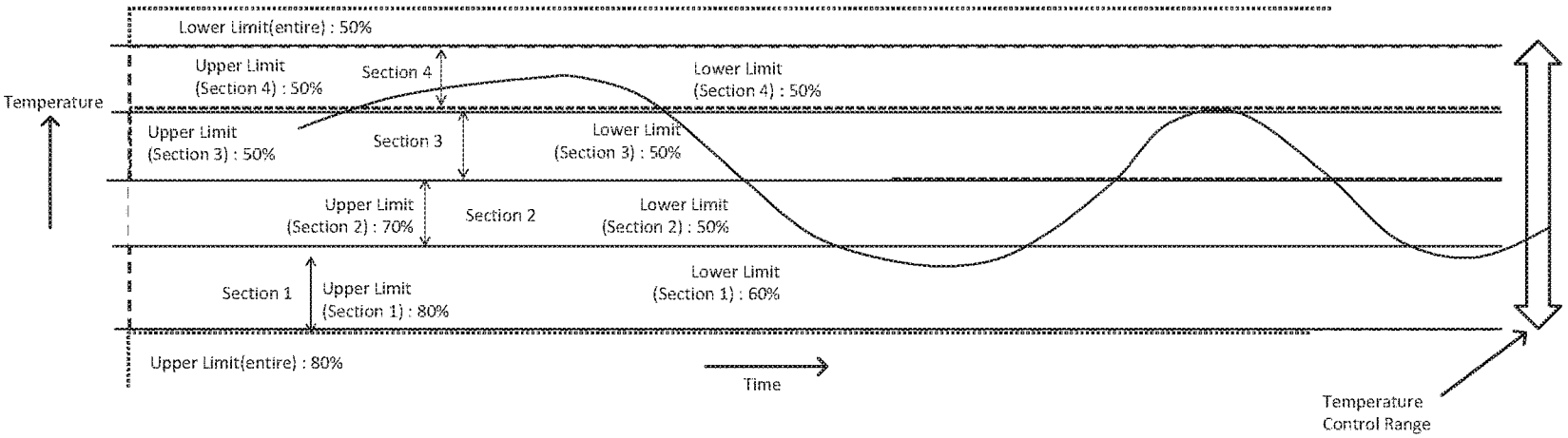

In FIG. 8, the temperature change of the heater during feedback control of the heater to a target temperature (under normal ambient temperature and normal humidity) is shown, where the initial heater temperature is in the range of Section 3 temperatures. The temperature change depicted in FIG. 8 employs upper and lower limit power supply levels that have been converted in ACT 208 to account for stored maximum and minimum power supply levels from a previous heating job.

FIG. 9 is another example of the table showing the upper and lower limits of power supply levels under normal ambient temperatures and humidity for different ranges of heater temperatures. This table differs from the one shown in FIG. 5 in that the upper and lower limit power supply levels are expressed as percentages for each of the three different medium types, M1, M2, and M3. By contrast, in the table of FIG. 5, the upper and lower limit power supply levels for only the medium type are expressed as percentages. For the other medium types M2 and M3, the percentages are calculated based on the percentages. By expressing the upper and lower limit power supply levels as percentages for all medium types, it is possible to enhance the processing speed and thus the start-up time for the sheet heating device.

According to embodiments, it is possible to set the appropriate power supply level of the power supply unit to heat sources based on the temperature of the device, the medium type, and environmental conditions, when starting the heating process for image forming or decoloring, so that the occurrence of the various adverse effects in the conventional heating process can be suppressed.

In the above embodiments, the sheet heating process in the case of image forming process is explained. However it is possible to apply the present invention to the heating process in the case of the decoloring process.

In the above embodiments, the image forming apparatus 1 includes the developing module D. However it is possible to apply the present invention to the apparatus which has the sheet heating device without the developing module D.

In the above embodiments, the image forming apparatus 1 includes the image scanning unit R. However it is not always necessary to include an image scanning function.

In the above embodiments, halogen lamps are applied as the heat source in the heat roller 76 and the entrance side roller 71. However, other type of the heat source such as a ceramic heater, an electromagnetic induction heating type heater, or various combinations of the above-described heat sources.

Further, in the above embodiments, various combinations of the heat roller, the endless belt for pressing a sheet against the heat roller, and a press roller for pressing a sheet against the heat roller, can be applied.

In the above embodiments, upper limit and lower limit power supply levels are set for each of a plurality of predetermined temperature ranges. However, it is not necessary to divide the temperature range into a plurality of temperature ranges. Instead, the upper and lower limit power supply levels may be expressed as a function of a temperature.

In the above embodiments, the sheet heating device 7 has the endless belt 73 to press a sheet against the heat roller 76. However it is possible to apply the present invention to the apparatus which has only one pressing roller to press a sheet against the heat roller 76.

In the above embodiments, the developing module D can perform a multi-color image forming process onto a sheet using multiple colorants. However it is possible to apply the present invention to the apparatus which uses only one colorant (mono-color) to form an image on a sheet.

In the above embodiments, the environment sensor 54 detects the ambient temperature and humidity. However, it is possible to acquire the information indicating at least one of the ambient temperature and humidity through the communication I/F 56.

Embodiments can be carried out in various forms without departing from main characteristics thereof. The embodiments are merely exemplary in every aspect and should not be limitedly interpreted. The scope of the present invention is indicated by the scope of claims. The text of the specification does not restrict the scope of the invention. All variations and various improvements, alterations, and modifications belonging to the scope of equivalents of the scope of claims are within the scope of the present invention.

What is claimed is:

1. A sheet heating device comprising:

a heater;

a power supply for the heater;

a temperature sensor configured to detect a temperature of the heater;

a control unit configured to set an initial power supply level of the power supply at a start of a sheet heating job by the heater based on the sheet heating job and according to whether or not maximum and minimum power supply levels from a last sheet heating job are stored, and control the power supply level of the power supply during the sheet heating job based on a temperature detected by the temperature sensor.

2. The sheet heating device according to claim 1, further comprising:

an environment sensor configured to detect ambient temperature and ambient humidity, wherein the control unit is configured to set the initial power supply level of the power supply at the start of the sheet heating job based on whether or not the detected ambient temperature and the detected ambient humidity is within a normal range.

3. The sheet heating device according to claim 1, further comprising:

a media sensor configured to detect a type of medium to be subjected to heating by the heater during the sheet heating job, wherein wherein the control unit is configured to set the initial power supply level of the power supply at the start of the sheet heating job based on the type of medium.

4. The sheet heating device according to claim 3, wherein the controller determines the initial power supply level of the power supply for a medium of a standard type and adjusts the initial power supply level for different medium types by multiplying a predetermined coefficient corresponding to the detected medium type.

5. The sheet heating device according to claim 3, wherein the controller retrieves from storage the initial power supply level of the power supply that has been predetermined for the detected medium type.

6. The sheet heating device according to claim 1, wherein the control unit is configured to set the initial power supply level of the power supply at the start of the sheet heating job according to when the last sheet heating job completed.

7. The sheet heating device according to claim 1, wherein the control unit is configured to set the initial power supply level of the power supply at the start of the sheet heating job to an upper limit predefined for a temperature range that includes the current temperature of the heater.

8. The sheet heating device according to claim 1, wherein if the maximum and minimum power supply levels from a last sheet heating job are stored, the control unit determines a maximum power supply level based on the current sheet heating job and adjusts the initial power supply level of the power supply based on a ratio of the maximum power supply level of the current sheet heating job to the maximum power supply level of the last sheet heating job.

9. A temperature control method for a sheet heating device having a heater, a temperature sensor configured to detect the temperature of the heater, and a power supply for the heater, the method comprising:

detecting a temperature of the heater using the temperature sensor;

setting an initial power supply level of the power supply at a start of a sheet heating job by the heater based on the sheet heating job and according to whether or not maximum and minimum power supply levels from a last sheet heating job are stored; and controlling the power supply level of the power supply during the sheet heating job based on a temperature detected by the temperature sensor.

10. The method according to claim 9, further comprising:

detecting ambient temperature and ambient humidity, wherein the initial power supply level of the power supply is set at the start of the sheet heating job based on whether or not the detected ambient temperature and the detected ambient humidity is within a normal range.

11. The method according to claim 9, further comprising:

detecting a type of medium to be subjected to heating by the heater during the sheeting heating job, wherein the initial power supply level of the power supply is set at the start of the sheet heating job based on the type of medium.

12. The method according to claim 9, wherein the initial power supply level of the power supply at the start of the sheet heating job is set to an upper limit predefined for a temperature range that includes the current temperature of the heater.

13. The method according to claim 9, further comprising:

if the maximum and minimum power supply levels from a last sheet heating job are stored, determining a maximum power supply level based on the current sheet heating job and adjusting the initial power supply level of the power supply based on a ratio of the maximum power supply level of the current sheet heating job to the maximum power supply level of the last sheet heating job.

14. A sheet heating device comprising:

a heater;

a power supply for the heater; and a control unit configured to set an initial power supply level of the power supply at a start of a sheet heating job by the heater based on the sheet heating job and according to maximum and minimum power supply levels from a last sheet heating job, determine upper and lower limit power supply levels of the power supply for each of a plurality of temperature ranges, and control a temperature of the heater during the sheet heating job by setting the power supply level of the power supply to one of the upper and lower limit power supply levels based on the current temperature of the heater.

15. The sheet heating device according to claim 14, wherein the control unit sets the power supply level of the power supply to a lower limit power supply level when the temperature of the heater is above a target temperature.

16. The sheet heating device according to claim 14, wherein the control unit sets the power supply level of the power supply to an upper limit power supply level when the temperature of the heater is below a target temperature.

17. The sheet heating device according to claim 14, wherein the control unit retrieves the upper and lower limit power supply levels from storage and adjusts the upper and lower limit power supply levels based on a medium type of a sheet that is being heated by the heater.

18. The sheet heating device according to claim 14, wherein the control unit retrieves the upper and lower limit power supply levels from storage and adjusts the upper and lower limit power supply levels if an ambient temperature or ambient humidity is outside a normal range.

19. The sheet heating device according to claim 14, wherein the control unit retrieves the upper and lower limit power supply levels from storage and adjusts the upper and lower limit power supply levels based on the maximum and minimum power supply levels from the last sheet heating job.

20. The sheet heating device according to claim 18, wherein the control unit adjusts the upper and lower limit power supply levels by different amounts depending on whether the current heater temperature is between first and second threshold temperatures or greater than both the first and second threshold temperatures.

* * * * *